United States Patent [19]

Howse

[11] 4,376,797

[45] Mar. 15, 1983

[54] PRETREATING INORGANIC SURFACES WITH AMMONIUM SALT OF THIOGLYCOLIC ACID

[75] Inventor: Clifford G. Howse, Al-Khobar, Saudi Arabia

[73] Assignee: Mohammed N. Al-Hajry, Ak-Lhobar, Saudi Arabia

[21] Appl. No.: 289,646

[22] Filed: Aug. 3, 1981

[51] Int. Cl.[3] ..... B05D 3/10

[52] U.S. Cl. ..... 427/302; 106/14.18; 148/6.24; 252/121; 427/399; 427/407.1; 427/409; 427/410

[58] Field of Search ..... 427/385.5, 386, 388.4, 427/299, 393.6, 327, 388.1, 302, 407.1, 409, 420, 399; 148/6.24; 106/14.18; 252/121

[56] References Cited

U.S. PATENT DOCUMENTS 2,491,066 12/1949 Wasson et al. ..... 148/6.24
3,411,940 11/1968 Lopez et al. ..... 427/302 X

FOREIGN PATENT DOCUMENTS 976273 11/1964 United Kingdom .
1130540 10/1968 United Kingdom .
1308391 2/1973 United Kingdom .
1532230 11/1978 United Kingdom .

*Primary Examiner*—Thurman K. Page
*Attorney, Agent, or Firm*—Sughrue, Mion, Zinn, Macpeak & Seas

[57] ABSTRACT

A method of treating inorganic materials such as metals to ensure strong adhesion of a subsequently applied coating of another material, such as a paint, comprises the steps of applying to a surface of the material a composition containing a complexing agent comprising both a sulph-hydro and a carboxylic acid group and applying over the complexing agent a film-forming coating which also contains a complexing agent comprising both a sulph-hydro and a carboxylic acid group and/or an anti-oxidant.

8 Claims, No Drawings

PRETREATING INORGANIC SURFACES WITH AMMONIUM SALT OF THIOGLYCOLIC ACID

BACKGROUND OF THE INVENTION

This invention relates to methods of treating surfaces of inorganic materials, such as metals, and more particularly to the surface treatment of materials which are liable to oxidisation. It is also, however, applicable to the treatment of surfaces of other materials such as tile, concrete, stone, terrazzo and similar inorganic materials.

SUMMARY OF THE INVENTION

It is the object of the invention to provide a method of treating surfaces of inorganic materials which will ensure strong adhesion of a coating of another material, such as paint, applied to the surface.

According to the present invention, a method of treating a surface of an inorganic material comprises the steps of applying to a surface of the material a composition containing a complexing agent comprising both a sulph-hydro and a carboxylic acid group and applying over the complexing agent a film-forming coating which also contains a complexing agent comprising both a sulph-hydro and a carboxylic acid group and/or an anti-oxidant.

The composition applied in the first step may be an alkaline solution of the complexing agent. A preferred example of such a complexing agent is an ammonium salt of thioglycolic acid, which is preferably applied in the form of a mildly alkaline aqueous solution with a pH value between 7.5 and 10, though it is also possible to apply it as an alcoholic solution. Another example which has proved effective is obtained by neutralising thioglycolic acid with triethanolamine. The surface of the inorganic material before treatment should be free from excessive loose particles, e.g. of rust or scale, but a certain degree of oxidation of the surface is desirable.

An ammoniacal solution of thioglycolic acid is known to react with iron to form a complex ferrous thioglycolate ion. The complexing agent used in the first step of the method of the present invention is believed to form a complex with metallic or semi-metallic substances (e.g. Fe or Si) in the surface being treated. In the case of oxidisable metals the complexing action is valuable in blocking access of oxygen to the surface. The complexing agent may also, or alternatively, act as an anti-oxidant or oxygen scavenger which reacts with any oxygen that may be present. In the case of a metal surface, e.g. iron, the surface is thus "passivised" and protected from oxidisation. The applied complexing agent, however, appears to decompose after a time, say 48 hours, so that the protection resulting from the first step of the method would be only temporary. The major advantage of this invention lies in the fact that the complexing agent applied in the first step enables the coating applied in the second step to have a very high degree of adhesion to the surface.

The film-forming coating applied in the second step may be a paint, e.g. a primer paint; for example a paint based on a resin which will react with carboxylic acid groups such as those present in the complexing agent. Thus a paint based on a polyurethane resin, or an alkyd resin or an epoxy resin may be employed.

Tests have proven that a very high degree of adhesion of the paint to the surface of the material can be achieved by a suitable choice of conditions. It is believed that the adhesion is caused by reaction between the paint and the carboxylic acid groups of the complexing agent applied in the first step in the process. This high degree of adhesion is dependent on the inclusion of a complexing agent of the above-specified kind and/or an anti-oxidant in the paint or other film-forming coating. The reason for this is believed to be due to the action of the complexing agent and/or the anti-oxidant in preventing diffusion of oxygen through the film-forming coating to the underlying surface of the material. The best results are obtained where the same complexing agent is present in the film-forming coating as in the composition applied in the first step and is also included in any further coatings, such as finish coats of paint, but the use of another type of anti-oxidant in such subsequent coatings is also effective. Adequate results, though without the very high degree of adhesion, can also be obtained by incorporating the complexing agent only in the first primer paint coating applied to the treated surface.

As mentioned above, the composition containing the complexing agent should be applied to a surface of the material which is free from excessive loose particles. In most cases, this will necessitate a preliminary step of cleaning the surface to remove any loose material, such as scale, and to degrease it, leaving the surface neutral or slightly alkaline for the subsequent application of the alkaline solution of the complexing agent. Where a degreasing treatment is effected by means of an alkaline detergent which does not decompose the complexing agent, the complexing agent may be incorporated in the detergent so that the degreasing and the application of the complexing agent to the clean surface are combined in a single step.

The method of the invention has been employed to produce highly adherent coatings on the surfaces of iron, steel, galvanised iron, stainless steel, aluminium, tile, terrazzo, concrete and stone.

A particularly useful application is for the application of non-slip coatings, for example on galvanised iron stair treads, or on floorings of tile or terrazzo material.

DETAILED DESCRIPTION OF THE INVENTION

Specific embodiments of this invention will now be described in more detail by way of example.

When the method of the invention is to be applied to a surface of iron or steel it is first essential to remove excess scale or other loose material, such as heavy rust, by mechanical means, such as wire brushing or where the material is in the form of a sheet or strip issuing from a mill by descaling rollers. In the latter case, no further cleaning may be necessary, but in general it will be necessary to carry out a degreasing step by conventional means, e.g. application of a strong alkaline cleaning agent such as caustic soda. The effect of these preliminary cleaning steps should be to ensure that the surface is firm and does not carry any loose material, and that the surface is neutral or mildy alkaline (e.g. pH 7 to 10). The presence of iron oxide does not have a deteriorating effect and can be beneficial.

The cleaned surface is then treated with the complexing agent in the form of an aqueous ammoniacal solution of thioglycolic acid, i.e. an aqueous solution of ammonium thioglycolate.

The solution is formed by diluting thioglycolic acid at a ratio of one part thioglycolic acid to six parts distilled water and adding 0.880 ammonia solution until a pH of 9/9.5 is achieved, thus producing an approximately 70% w/w solution of ammonium thioglycolate in water. In many cases, provided that the surface is free from loose material, the solution of ammonium thioglycolate can be mixed with a degreasing agent so as to carry out the degreasing step simultaneously with the application of the complexing agent. For these two steps to be combined, however, it is important that the degreasing agent should not be too strongly alkaline. The combined solution of the degreasing agent and ammonium thioglycolate should have a pH value between 7.5 and 10. For this purpose the degreasing agent may be chosen from among the many known alkaline detergents of appropriate pH value which are commercially available. The iron or steel surface which has thus been treated is found to be temporarily protected from oxidisation or passivised for a period of up to 48 hours. It is believed that the ammonium thioglycolate ($HS.CH_2.COO.NH_4$) forms a complex or a chelate with the Fe through the SH group and thereby blocks access of atmospheric oxygen to the iron or steel surface.

While the surface is in this condition the chosen coating (e.g. a primer paint) is applied to the treated or passivised surface before the initial coating of thioglycolate has had time to decompose. In order to obtain improved adhesion of the chosen coating as compared with that obtainable by conventional methods it is necessary to incorporate in the coating 5 to 25 milliliters of ammonium thioglycolate 70% w/w solution to 5 liters of the chosen coating. After addition of the thioglycolate to the coating the latter is stirred for up to 15 minutes before application to the treated or passivised surface of the iron or steel. On drying the coating is found to adhere very strongly indeed to the surface.

A further coating or coatings may be applied to the primer coated surface, these further coatings all desirably also containing similar additions of ammonium thioglycolate, to ensure that a strong bond is produced between each coating and the preceding coating as well as between the surface of the metal and the coatings.

Specific treatments according to the invention for various metal articles are described in the following examples.

EXAMPLE 1

On mild steel up to 26 gauge, a combined degreasing and passivising treatment was effected with an aqueous solution containing one part of the 70% ammonium thioglycolate solution to 25 parts of a commercially available alkaline detergent. Excess detergent was removed from the surface, which was dried, and a primer coating was applied of a polyurethane based paint containing 25 ml of the ammonium thioglycolate solution to 5 liters of paint, mixed for 15 minutes before application.

EXAMPLE 2

On mild steel of 26 gauge to ¼ inch plate, the process of Example 1 was repeated except that the degreasing and passivising step was carried out with 1 part of the ammonium thioglycolate solution to 5 parts of the detergent, and in the primer coating only 15 ml of the ammonium thioglycolate solution was used in 5 liters of the polyurethane paint.

EXAMPLE 3

On mild steel thicker than ¼ inch plate, a preliminary degreasing step was effected with a strong aqueous solution of caustic soda, which was then rinsed off and the surface dried but not neutralised. The surface was then treated with the 70% solution of ammonium thioglycolate referred to above. After this had been dried, a primer coat of the polyurethane paint containing 5 ml of the ammonium thioglycolate solution to 5 liters of paint was applied.

EXAMPLE 4

In the case of articles of stainless steel, a preliminary cleaning step was effected with an aqueous solution of hydrochloric acid. This was followed by a combined degreasing and passivising treatment using 10 parts of the alkaline detergent mentioned above to 1 part of the ammonium thioglycolate solution. After this had been dried, a primer coating was applied of the polyurethane paint containing 5 ml of the ammonium thioglycolate solution to 5 liters of the paint.

EXAMPLE 5

For treatment of articles of aluminium or aluminium alloy, the surface was first cleaned with a conventional acid descaler, followed by a degreasing and passivising treatment with 10 parts of the above-mentioned alkaline detergent to 1 part of the ammonium thioglycolate solution. After this had been dried, a primer coating was applied of the polyurethane paint containing 5 ml of the ammonium thioglycolate to 5 liters of the paint.

In all of these examples, the primer coating was found to have exceptionally good adhesion to the underlying metal.

EXAMPLE 6

To apply a non-slip coating to clip-on stair treads of ½ mm galvanised steel, a combined degreasing and passivising treatment was effected as in Example 1 with an aqueous solution of 1 part of the ammonium thioglycolate solution to 25 parts of the alkaline detergent. Excess detergent was removed and the surface dried. A primer coating of a two-pot polyurethane paint containing ammonium thioglycolate was then applied; 25 ml of the ammonium thioglycolate solution was mixed into 5 liters of the polyurethane base for 15 minutes, the hardener was mixed in, and the primer coating was applied to the stair treads. Two finish coats of a two-pot polyurethane paint containing ammonium thioglycolate and an inert non-slip synthetic resin filler were then applied; these coats were made up as for the primer coat, except that 1 kg of finely powdered synthetic resin was mixed in with the hardener. The polyurethane paint was found to harden before the powdered resin filler could dissolve in it to any substantial extent. The non-slip coatings thus produced on the stair treads were found to have improved wear characteristics as compared with such coatings produced by conventional painting processes.

EXAMPLE 7

To apply a non-slip coating to a terrazzo floor, the clean floor was treated with the 70% solution of ammonium thioglycolate described above.

A two-pot polyurethane varnish-type seal was then applied, with 15 ml of the ammonium thioglycolate solution mixed into 5 liters of the polyurethane base for 15 minutes before addition of the hardener and application of the seal to the floor. The seal was allowed to dry for 2 hours.

Two further coatings of the seal were applied, each 5 liters of the seal containing, in addition to 15 ml of the ammonium thioglycolate solution, 1 kg of a finely powdered synthetic resin non-slip filler and a red pigment, which were mixed in with the hardener immediately before application to the floor. The coated floor had a smooth matt non-slip finish which was resistant to wear and soiling and which could easily be cleaned by conventional methods.

I claim:

1. A method of treating a surface of an inorganic material comprising the steps of applying to a surface of the material a composition containing an alkaline solution of an ammonium salt of thioglycolic acid and applying over the said composition a film-forming coating composition which is based on a resin selected from the group consisting of polyurethane resins, alkyd resins and epoxy resins and which also contains an ammonium salt of thioglycolic acid and/or an anti-oxidant.

2. A method according to claim 1, wherein the ammonium salt of thioglycolic acid is applied to the surface in the form of a mildly alkaline aqueous solution with a pH value between 7.5 and 10.

3. A method according to claim 1, wherein the ammonium salt of thioglycolic acid is applied to the surface in the form of an alcoholic solution.

4. A method according to claim 1, wherein the film-forming coating is a paint.

5. A method according to claim 1, wherein a further coating or coatings of film-forming material is or are applied, the or each said further coating also including the same ammonium salt of glycolic acid.

6. A method according to claim 1, wherein the surface of the material is subjected to a preliminary cleaning step to remove any loose material and to degrease it, before application of the composition containing the ammonium salt of glycolic acid.

7. A method according to claim 6, wherein the preliminary cleaning step leaves the surface neutral or slightly alkaline, with a pH value of 7 to 10.

8. A method according to claim 7, wherein an alkaline detergent which does not decompose the ammonium salt of glycolic acid is used, and the said salt is incorporated in the detergent so that the degreasing and the application of the said salt to the surface of the material are combined in a single step.

* * * * *